US009808133B2

(12) United States Patent
Lubbers et al.

(10) Patent No.: US 9,808,133 B2
(45) Date of Patent: Nov. 7, 2017

(54) SURFACE CLEANING DEVICE

(71) Applicant: KONINKLIJKE PHILIPS N.V., Eindhoven (NL)

(72) Inventors: Matthijs Hendrikus Lubbers, Eindhoven (NL); Pieter Kingma, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/916,704

(22) PCT Filed: Jul. 8, 2015

(86) PCT No.: PCT/EP2015/065528
§ 371 (c)(1),
(2) Date: Mar. 4, 2016

(87) PCT Pub. No.: WO2016/008773
PCT Pub. Date: Jan. 21, 2016

(65) Prior Publication Data

US 2016/0213214 A1 Jul. 28, 2016

(30) Foreign Application Priority Data

Jul. 14, 2014 (EP) ..... 14176910

(51) Int. Cl.

| | |
|---|---|
| ***A47L 7/00*** | (2006.01) |
| ***A47L 5/24*** | (2006.01) |
| ***A47L 1/15*** | (2006.01) |
| ***A47L 1/05*** | (2006.01) |
| ***A47L 9/06*** | (2006.01) |

(52) U.S. Cl.
CPC ..... *A47L 7/0004* (2013.01); *A47L 1/05* (2013.01); *A47L 1/15* (2013.01); *A47L 5/24* (2013.01); *A47L 7/0009* (2013.01); *A47L 9/0686* (2013.01)

(58) Field of Classification Search
CPC . A47L 7/0004; A47L 1/15; A47L 5/24; A47L 7/0009; A47L 5/0686
See application file for complete search history.

(56) References Cited

U.S. PATENT DOCUMENTS

| | | | | |
|---|---|---|---|---|
| 4,954,001 | A * | 9/1990 | Billat | A47L 1/08 15/121 |
| 5,328,283 | A * | 7/1994 | Viens | A47L 1/08 401/140 |
| 5,343,586 | A * | 9/1994 | Vosbikian | A47L 13/12 15/121 |
| 5,720,078 | A | 2/1998 | Heintz | |
| 8,312,588 | B2 * | 11/2012 | Yamaguchi | A47L 1/08 15/208 |

(Continued)

FOREIGN PATENT DOCUMENTS

| | | |
|---|---|---|
| CH | 544541 A | 1/1974 |
| DE | 102010038422 A1 | 1/2012 |

(Continued)

*Primary Examiner* — Dung Van Nguyen

(57) ABSTRACT

Surface cleaning device, comprising a cloth (C) placed on a porous material (PM), a reservoir (R) for collecting liquid absorbed by the cloth (C), and an arrangement (P) for applying under-pressure in the reservoir (R) so as to transfer liquid from the cloth (C) into the reservoir (R). A pore size of the porous material (PM) is between 1 μm and 50 μm.

9 Claims, 2 Drawing Sheets

(56) References Cited

U.S. PATENT DOCUMENTS

| | | | | |
|---|---|---|---|---|
| 2002/0078519 | A1* | 6/2002 | Boothby | A47L 1/06 15/121 |
| 2004/0134016 | A1 | 7/2004 | Kisela | |

FOREIGN PATENT DOCUMENTS

| | | | |
|---|---|---|---|
| DE | 102012104102 | A1 | 5/2013 |
| EP | 2014212 | A1 | 1/2009 |
| JP | 2006043444 | A | 2/2006 |
| NL | 8400673 | A | 10/1985 |
| WO | 2006091439 | A2 | 8/2006 |

* cited by examiner

SURFACE CLEANING DEVICE

This application is the U.S. National Phase application under 35 U.S.C. §371 of International Application No. PCT/EP2015/065528, filed on Jul. 8, 2015, which claims the benefit of International Application No. 14176910.9 filed on Jul. 14, 2014. These applications are hereby incorporated by reference herein.

FIELD OF THE INVENTION

The invention relates to a surface cleaning device.

BACKGROUND OF THE INVENTION

U.S. Pat. No. 5,720,078 discloses a suction device for removing liquids from a surface such as a floor. The device includes an air chamber formed from a top and a bottom plate, each of the plates having a respective top and bottom surface. The bottom plate includes a plurality of holes therethrough. The bottom surface of the bottom plate additionally includes fabric adjacent thereto and feet to hold the bottom plate of the device up off the floor to enable fluid to be suctioned through the bottom plate holes and into the chamber via a conventional source of suction. In an embodiment, each of said holes is between 0.030 to 0.250 inches in diameter.

WO 2006/091439 discloses a cleaning implement that provides multiple functions useful in cleaning windows and similar surfaces. There is a support head mounting a squeegee blade and (optionally) a scrubber and/or touch-up pad. There is also a collector absorbent pad that is mounted to the support head adjacent the squeegee blade. The collector can be made of an absorbent such as a porous plastic. Particularly preferred absorbents are porous polyethylene materials available from Porex.

DE 102012104102 discloses an apparatus having a handle connected with a liquid applicator over a pivot, and a suction opening part movably arranged relative to the liquid applicator.

There are nowadays more and more electric driven products suited for surface cleaning, which replace, for example, the well-known mop and bucket for floor cleaning, or the sponge and squeegee for window cleaning.

For cleaning surfaces in general, three steps can be identified. Step 1: bringing a liquid to the surface. Step 2: an agitation action for loosening and dissolving the dirt. Step 3: taking up the dirt including part of the liquid. For this last step, there are in general two solutions. The most common way is using a cloth or sponge like material (absorption), sometimes in combination with a squeegee to first collect the liquid and then absorb by cloth. The second solution is used by electrical appliances. Many of these cleaning appliances use suction/airflow, mainly in combination with double squeegees. The squeegee wipes the liquid from the surface and is collected just in front of the squeegee. The suction or airflow will than transport the liquid to a reservoir.

A good liquid pick up after the cleaning action has several advantages, minimize risk on floor damage, reducing drying time and especially for window cleaning it reduces stripes after drying. Stripes are caused by the evaporation of the liquid, and residue will remain on the window.

The main disadvantage of the bucket and mop principle is that the amount of liquid that remains on the floor is difficult to control. It strongly depends on how well the mop is wrung (this determines the amount of liquid that remains in the mop and the amount of liquid that can be absorbed by the mop).

Some buckets have a mechanical system that helps to wring the mop. Still the amount of liquid on the floor depends on the force the consumer puts on the wringer and also depends on the amount of force that is put on the mop by the consumer during cleaning the floor. This can result in a poor cleaning performance when the mop is too dry but even worse, it can result in damage to the floor when the mop is too wet.

The main disadvantage of window cleaning with sponge and squeegee is that the liquid is wiped of the window but is not collected by anything. This means that all the liquid runs down the window on to the window frame or window sill. There it can be dried by a cloth or sponge. But the liquid pick up is very little due to the limitations of absorption of the material. Consumers see this as a big hassle of wringing the cloth or sponge which results in liquid spillage etc.

A general disadvantage of the above mentioned manual cleaning methods is that the performance over time is not constant. A mop, cloth or sponge is getting increasingly dry during the cleaning action when releasing liquid to the surface, and is getting increasingly wet during the drying action when absorbing liquid from the surface.

Electric cleaning appliances solve the above issues by wiping the liquid from the surface by a squeegee and applying suction/airflow to transport the collected liquid to a reservoir. In general this is done by a double squeegee system. The main issues for the above mentioned system are that a rather big fan/motor must be used to generate sufficient airflow to transport the liquid, that the air and the liquid needs to be separated again and the fan/motor must be suited to handle moist or moist air. That means that this system is expensive and complex.

SUMMARY OF THE INVENTION

It is, inter alia, an object of the invention to provide an improved surface cleaning device. The invention is defined by the independent claim. Advantageous embodiments are defined in the dependent claims.

One aspect of the invention provides a surface cleaning device, comprising a cloth placed on a porous material, a reservoir for collecting liquid absorbed by the cloth, and an arrangement for applying under-pressure in the reservoir so as to transfer liquid from the cloth into the reservoir. In accordance with an aspect of the present invention, a pore size of the porous material (PM) is between 1 μm and 50 μm.

To solve the above mentioned issues, in one embodiment, a squeegee is used in combination with a new and innovative way of liquid transport. The way of liquid transport or absorption is the main element of this embodiment. The squeegee wipes the liquid from the surface, which liquid is collected by a cloth just in front of the squeegee. This cloth absorbs the liquid. The amount of liquid the cloth can absorb is rather limited but therefore this cloth is placed directly on a porous material. The porous material is part of a reservoir which can contain liquid. A small under-pressure is applied to the reservoir. When the cloth is wetted due to picking up liquid from the cleaned surface, a certain amount of liquid is sucked out of the cloth and will pass through the porous material into the reservoir due to the pressure difference. This cloth is therefore continuous kept dry/moist. Because the amount of liquid which can be absorbed is limited by the reservoir capacity rather than by the amount of liquid that can be absorbed by the cloth itself, an appliance can be built with the simplicity of a squeegee with a sponge without the difficulties of a double squeegee nozzle, so that no large fan or complex separation method is needed.

Another advantage of this embodiment is that the cloth can be sucked almost completely dry by applying more under-pressure. This means that the appliance can be stored with an almost dry cloth, which is much more hygienic than a wet cloth.

One embodiment of the invention thus provides a system for a continuous dry cloth which can be used for a surface cleaning device. The device has a reservoir for containing a liquid, and where part of the reservoir is made out of a porous material. A cloth is placed in direct contact of the porous material. A small under-pressure is applied to the reservoir. When the cloth is wetted due to picking up liquid from the cleaned surface, a certain amount of liquid be sucked out of the cloth and will pass though the porous material into the reservoir due to the pressure difference. This cloth is therefore continuous kept dry/moist. This cloth can be used for cleaning/drying surfaces, e.g. floors, windows.

The cloth can be attached on the porous material or the cleaning device using any known clamping/ tucking means or by using a Velcro strip among others. Further, the cloth and porous material can also be manufactured as an integral item wherein one layer is the cloth and the other layer is the porous material as is done in the case of a multilayer component. However, the embodiment of having the cloth as a removably attachable element gives the freedom of easy cleaning and replacement of the dirty cloth to the user.

These and other aspects of the invention will be apparent from and elucidated with reference to the embodiments described hereinafter.

DESCRIPTION OF EMBODIMENTS

Figure 1:
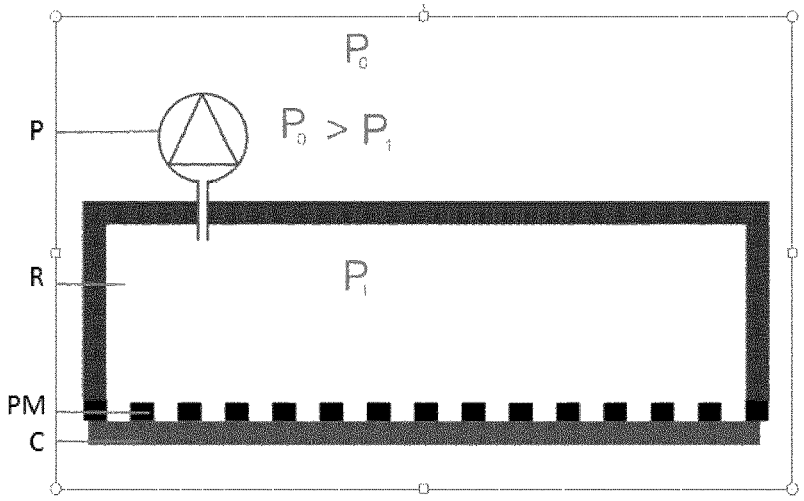
FIG. 1 shows an embodiment of a surface cleaning device in accordance with the present invention.

The essence of the embodiment of FIG. 1 is the porous material PM and the contact area with the cloth C. The porous material PM is preferably hydrophilic, and the pore size is chosen in such a manner that the material has a preference to pass liquid above air when a pressure difference is applied. Tests showed that a pore size between 1 μm and 50 μm is suited for this application.

The porous material PM may be a plastic sheet having pores. Alternatively, the porous material PM can be a porous polymer with liquid permeable properties as available from Porex Corporation and other porous polymer manufacturers.

The porous material PM is a part of the reservoir R or part of a soleplate that is a housing for the cloth or sponge to rest upon. The porous plastic is important as it has two functions:

a. Allow moisture from the cloth C to pass to the reservoir R because of under-pressure;
b. Do not allow the moisture collected in the reservoir R to come out again, i.e. allow moisture in one direction only and prevent from expelling it in the opposite direction.

This aspect of not expelling the moisture in another direction is indeed very important as otherwise the cloth C will become wet again. So if we remove the porous plastic and use a cloth or sponge alone, the under-pressure will suck liquid but will wet the cloth again. Also, the porous plastic will help to create a better pressure difference which cannot be achieved using the more porous/open structure of a sponge or cloth.

The cloth C that is intended for the cleaning/drying action is in direct contact with the porous material PM. Preferred is a thin microfiber or non-woven cloth. A thick cloth can be compressed during use by the consumer which can result in difference of performance and might give an excess of liquid when compressed. In a window cleaning application, the cloth or sponge is needed to capture the moisture that is trickling down when the squeegee is acting over the window.

The porous material PM may be part of the reservoir R. This reservoir R can be of any shape but should cover the whole porous area. In another embodiment, a smaller housing may house the porous material PM and the cloth C, and then channel (e.g. through gravity) the liquid passing through the porous plastic to a reservoir formed by a container downstream for holding dirty liquid. In this case, the capacity to hold liquid may be larger.

An arrangement P provides under-pressure over a surface formed by the porous material PM which is in contact with a wet cloth C in order to suck moisture that is captured in the cloth C while cleaning In a basic configuration, the arrangement P can be a simple syringe which can pump out moisture from the cloth C. So as long as the syringe is able to maintain the under-pressure inside the reservoir, any liquid in the cloth C can be sucked into the reservoir R. Also, point to note, porous plastic is hydrophilic and allows very little or no air in ideal conditions so the pressure created by syringe will suck moisture. In case of an arrangement P that is an electrically powered pump, the under-pressure is continuously generated, and in case of a syringe, the under-pressure is limited by the volume of the syringe.

It is possible to use the cloth for cleaning rather than drying, especially when pumping action is reversed.

This system can be built in different embodiments. For example, in combination with a squeegee, specific for window cleaning. Or in combination with a steamer, specific for hard floor cleaning Or in combination with vacuum cleaner for a so-called vac&mop appliance.

Figure 2:
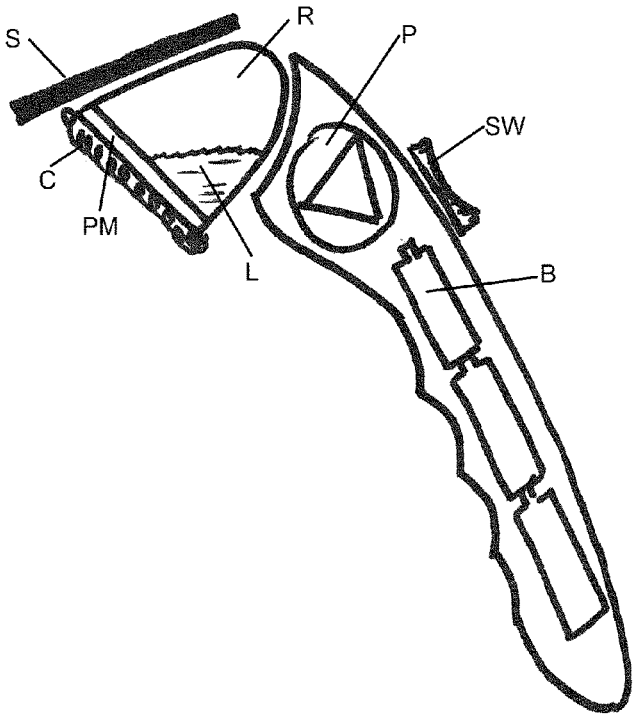
FIG. 2 shows an embodiment of a window cleaning device in accordance with the present invention.

FIG. 2 shows an embodiment of a window cleaning device in accordance with the present invention. A squeegee S collects liquid L from a window, which is collected by the cloth, and on via the porous material PM, and collected in the reservoir R due to under-pressure applied by the pump P. While not shown in this schematic drawing, the pump P is in contact with the reservoir R so as to provide under-pressure. In this embodiment, the pump P is an electrical pump, powered by batteries B. A switch SW serves to switch the pump P on/off.

Figure 3:
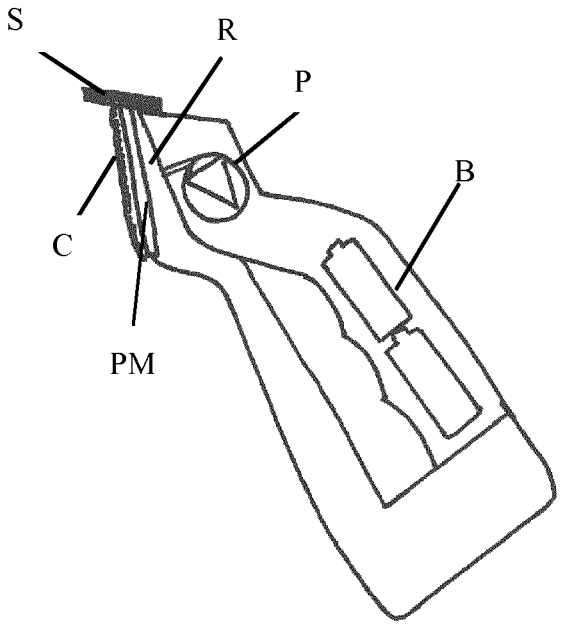
FIG. 3 shows another embodiment of a window cleaning device in accordance with the present invention.

FIG. 3 shows another embodiment of the window cleaning device in accordance with the present invention wherein the waste liquid is not contained directly behind the porous material PM assembly. In this embodiment, the waste liquid is contained in the body of the window cleaning device as compared to the device shown in FIG. 1. This means that the device will have a larger reservoir R or a separate tank where the waste liquid is collected. The advantage offered by these configurations is that more liquid can be collected and stored allowing a fairly longer operation time.

Also, in yet another embodiment, the device can have a separate storage tank for storing water or a cleaning liquid for spraying or applying on the surface to be cleaned as the case with a conventional window cleaning device. Further, the spraying of the cleaning liquid or water to moisten the surface to be cleaned can be done by using a manual spray mechanism or by using a pump. Also, the device can use the same pump that is used to create under pressure in order to create the over pressure required to pump out water from the device. Furthermore, few other advantages that are offered by this device are that the device uses a very low power pump as compared to commercially available suction-based cleaners, so that the batteries used to power the device can last for a very long time. The pump is indeed small and can be placed anywhere as only a small tube needs to be connected with the reservoir for creating the required under pressure.

It will be apparent to a person having ordinary skill in the art that the surface cleaning device can be used over any surface—flat or bumpy. Also, on any surface orientation such as vertical wall or glass pane, or a horizontal surface such as a floor. Further, the device can be used on any surface type such as a hard floor. Moreover, the device can be designed from an ergonomic point so that a user can hold this comfortably i.e. with a handle or with a surface on the device well suited for gripping.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. In the claims, the notion "cloth" also covers an embodiment in which a sponge covers the porous material PM. The mere fact that certain measures are recited in mutually different dependent claims does not indicate that a combination of these measures cannot be used to advantage.

The invention claimed is:

1. Surface cleaning device, comprising:

a cloth (C) placed on a porous material (PM), a pore size of the porous material (PM) being between 1 μm and 50 μm;

a reservoir (R) for collecting liquid absorbed by the cloth (C); and an arrangement (P) for applying under-pressure in the reservoir (R) so as to transfer liquid from the cloth (C) into the reservoir (R).

2. Surface cleaning device as claimed in claim 1, wherein the cloth (C) is a thin microfiber or non-woven cloth.

3. Surface cleaning device as claimed in claim 1, wherein the porous material (PM) is a porous plastic or a porous polymer with water permeable properties.

4. Surface cleaning device as claimed in claim 1, wherein the porous material (PM) is hydrophilic.

5. Surface cleaning device as claimed in claim 1, wherein the porous material (PM) is a part of the reservoir (R).

6. Surface cleaning device as claimed in claim 1, wherein the porous material (PM) does not allow the liquid collected in the reservoir (R) to come out again through the pores.

7. Surface cleaning device as claimed in claim 1, wherein the porous material (PM) and the cloth (C) are one multi-layer component.

8. Surface cleaning device as claimed in claim 1, wherein the arrangement (P) for applying under-pressure comprises a syringe.

9. Surface cleaning device as claimed in claim 1, wherein the arrangement (P) for applying under-pressure comprises a pump.

* * * * *